US008905359B2

(12) United States Patent
Li et al.

(10) Patent No.: US 8,905,359 B2
(45) Date of Patent: Dec. 9, 2014

(54) METHOD AND INSTRUMENTATION FOR DETECTION OF RAIL DEFECTS, IN PARTICULAR RAIL TOP DEFECTS

(75) Inventors: Zilli Li, Nootdorp (NL); Maria Molodova, Delft (NL)

(73) Assignee: Technische Universiteit Delft, Delft (NL)

( * ) Notice: Subject to any disclaimer, the term of this patent is extended or adjusted under 35 U.S.C. 154(b) by 0 days.

(21) Appl. No.: 13/372,322

(22) Filed: Feb. 13, 2012

(65) Prior Publication Data

US 2012/0199700 A1 Aug. 9, 2012

Related U.S. Application Data

(63) Continuation of application No. PCT/NL2010/050487, filed on Jul. 29, 2010.

(30) Foreign Application Priority Data

Aug. 13, 2009 (NL) ..... 2003351

(51) Int. Cl.
*B61L 23/04* (2006.01)
*B61K 9/10* (2006.01)

(52) U.S. Cl.
CPC *B61K 9/10* (2013.01); *B61L 23/045* (2013.01)
USPC ..... 246/120

(58) Field of Classification Search
USPC ..... 246/120, 121, 167 R, 169 R, 169 A; 105/96, 167, 168, 171, 218.1
See application file for complete search history.

(56) References Cited

U.S. PATENT DOCUMENTS 3,558,876 A * 1/1971 Tillman et al. ..... 246/169 S
4,129,276 A * 12/1978 Svet ..... 246/169 S (Continued)

FOREIGN PATENT DOCUMENTS

EP 1593572 9/2005
WO 2011/019273 2/2011

OTHER PUBLICATIONS

Meggitt, , "Endevco Model 7259B Isotron Accelerometer", Endevco Model 7259B Isotron Accelerometer Product Brochure, Jul. 1988.

(Continued)

*Primary Examiner* — R. J. McCarry, Jr.
*Assistant Examiner* — Jean Charleston
(74) *Attorney, Agent, or Firm* — Peacock Myers, P.C.; Jeffrey D. Myers

(57) ABSTRACT

Method and instrumentation for detection of rail defects, in particular rail top defects, in a railway-track by measuring an axle box acceleration signal of a rail vehicle, wherein a longitudinal axle box acceleration signal is used as a measure to detect the occurrence of said rail defects. The method also includes measuring a vertical axle box acceleration signal of said rail vehicle, whereby the longitudinal axle box acceleration signal is used in combination and simultaneously with said vertical axle box acceleration signal. It is preferred that the longitudinal axle box acceleration signal is used to remove from said vertical axle box acceleration signal a signal-part that relates to vibrations of the rail vehicle's wheel set, including the bearing and axle box, and that the axle box acceleration signals are filtered for removing signal-parts contributed by vibrations of the track, including the rail, rail pads, fasteners, sleepers, and ballast.

2 Claims, 3 Drawing Sheets

(56) References Cited

U.S. PATENT DOCUMENTS

| | | | | |
|---|---|---|---|---|
| 4,376,883 | A * | 3/1983 | Dao et al. | 219/109 |
| 5,021,626 | A * | 6/1991 | Boyd et al. | 219/109 |
| 6,416,020 | B1 * | 7/2002 | Gronskov | 246/169 D |
| 6,668,239 | B1 * | 12/2003 | Gilbert et al. | 702/188 |
| 7,539,596 | B2 * | 5/2009 | Zoll et al. | 702/183 |
| 2002/0056398 | A1 * | 5/2002 | Bachtiger et al. | 105/157.1 |
| 2007/0255509 | A1 * | 11/2007 | LeFebvre et al. | 702/33 |

OTHER PUBLICATIONS

Bocciolone, M. et al., "A Measurement System for Quick Rail Inspection and Effective Track Maintenance Strategy", Mechanical Systems and Signal Processing, vol. 21, Issue 3, Apr. 2007, 1242-1254.

* cited by examiner

METHOD AND INSTRUMENTATION FOR DETECTION OF RAIL DEFECTS, IN PARTICULAR RAIL TOP DEFECTS

CROSS-REFERENCE TO RELATED APPLICATIONS

This application is a continuation of International Patent Application PCT/NL2010/050487 entitled "Method and Instrumentation for Detection of Rail Defects, in Particular Rail Top Defects", filed Jul. 29, 2010 to Technische Universiteit Delft which is a continuation of Netherlands Patent Application No. 2003351, entitled "Method and Instrumentation for Detection of Rail Defects, in Particular Rail Top Defects", to Technische Universiteit Delft, filed on Aug. 13, 2009, and the specifications and claims thereof are incorporated herein by reference.

STATEMENT REGARDING FEDERALLY SPONSORED RESEARCH OR DEVELOPMENT

Not Applicable.

INCORPORATION BY REFERENCE OF MATERIAL SUBMITTED ON A COMPACT DISC

Not Applicable.

COPYRIGHTED MATERIAL

Not Applicable.

BACKGROUND OF THE INVENTION

1. Field of the Invention (Technical Field)

The invention relates to a method for detection of rail defects, in particular rail top defects, in a railway-track by measuring an axle box acceleration signal of a rail vehicle.

2. Description of Related Art

Rail defects, in particular rail top defects, as referred to in this document are local short vertical geometrical deviations that may cause impact between the rails of the railway-track and the rolling wheels of a rail vehicle. Aspects like indentations, differential wear and differential plastic deformation, inhomogeneous rail material and a defective manufacturing process of the rails may contribute to this problem. Unless repaired a light rail top defect or squat will grow into a moderate defect, and subsequently into a severe defect. Rail fracture and damages to its fastening, the rail pads, sleepers and ballast may also ultimately occur if no remedial action is taken. From the point of view of railway operation, safety and availability, rail defects, in particular rail top defects, should be detected and removed at the earliest possible occasion in order to prevent their further development into more serious rail defects.

Most commonly rail defects, and squats in particular, are detected by human inspection or by an ultrasonic technique. For the human inspection inspectors walk along the rail to find the rail defects, or alternatively inspect photos or a video record of the rails. In any case the naked human eye is needed to carry out the inspection. The ultrasonic inspection technique is only applicable when the cracks are deeper than approximately 7 mm in order to allow that the ultrasonic technique can be used for reliable detection of such cracks.

It has also been proposed to use eddy-current technology for detection of rail top defects, and even the use of acoustic detection has been proposed, however this latter technique is only applicable for detection of severe rail top defects, which emit detectable impact noise.

In the article "A Measurement System for Quick Rail Inspection and Effective Track Maintenance Strategy" published in Mechanical Systems and Signal Processing 21 (2007), pages 1242-1254, by M. Boccilione, et al, instrumentation for measuring lateral and vertical axle box acceleration of a rail vehicle is proposed which is usable for detection of defects in a railway track.

The measured vertical axle box acceleration of a rail vehicle as is known from said article is usable for the detection of a severe rail top defect. The measured axle box accelerations at a rail top defect are basically vibrations stemming from three sources, being 1. Vertical vibrations of the track, including those of the rail, rail pads, fastening, sleepers, ballast etc.
2. Vertical deformation and relative motion of the wheel and rail at the defect, and
3. Vibration of the wheel set, including also those of the bearing and of the axle box.

The above-mentioned vibration source number 2, being the vertical deformation and relative motion of the wheel and rail at the defect is the signal that is of interest. For severe rail defects, in particular rail top defects, the vibration sources 1 and 2 are relatively strong. These sources can however be distinguished because of their different frequency characteristics. For less severe rail defects, the vibration signals become less strong, and vibration source number 3 may become relatively more dominant than the other sources of vibration. Both aspects contribute to deterioration of the signal-to-noise ratio making it hard to detect light or moderate rail defects, in particular rail top defects.

EP-A-I 593 572 discloses a method for identifying locations along a track at which the wheel of a railway vehicle subjects the rail along which the vehicle is travelling to longitudinal forces, comprising the measuring of an acceleration signal of a wheel of the rail vehicle, wherein a longitudinal acceleration signal is used in combination and simultaneously with a vertical acceleration signal.

BRIEF SUMMARY OF THE INVENTION

It is an object of the invention to provide a method for detection of rail defects, in particular rail top defects, in a railway-track, by which an accurate and reliable localization of such rail defects can be realized.

BRIEF DESCRIPTION OF THE SEVERAL VIEWS OF THE DRAWINGS

Some measurement results with the application of the instrumentation in accordance with the invention are shown in the drawing of FIGS. 1 and 2 respectively.

In the drawings.

In both figures axle box acceleration signals are shown to represent measured rail irregularities on a revenue track. In both figures the abscissa is the kilometer-position along the track, and the ordinate is the measured acceleration signal.

DETAILED DESCRIPTION OF THE INVENTION

In order to meet the objective of the invention and to realize further advantages as will become apparent hereinafter, the method for detection of rail defects, in particular rail top defects, in accordance with the invention is characterized by one or more of the appended claims.

The method for detection of rail (top) defects in a railway-track in accordance with the invention is characterized in that the longitudinal axle box acceleration signal is used to remove from said vertical axle box acceleration signal a signal-part that relates to vibrations of the rail vehicle's wheel set, including the bearing and axle box.

As compared to the vertical axle box acceleration signal, the longitudinal axle box acceleration signal is of a relatively high strength, and moreover this longitudinal signal is a relatively undisturbed signal with a favorable signal-to-noise ratio. The longitudinal axle box acceleration signal is used in combination and simultaneously with the measured vertical axle box acceleration signal, in order to subtract from the latter signal the signal-part that relates to the vibration of the wheel set, including also those of the bearing and of the axle box. Due to the earlier mentioned different frequency characteristics, the vibration signal-of-interest relating to the deformation and relative motion of the wheel and rail at the defect can be separated from the vertical vibrations of the track. According to the invention it is therefore proposed that the longitudinal axle box acceleration signal is used to remove from said vertical axle box acceleration signal the signal-part that relates to vibrations of the rail vehicle's wheel set, including the bearing and axle box.

Further from the above it will be clear that according to the invention it is preferred that the axle box acceleration signals are filtered for removing signal-parts contributed by vibrations of the track, including the rail, rail pads and fastening, sleepers, and ballast.

It will further be clear that in order to be able to execute the method of the invention, instrumentation is required for measuring the axle box acceleration of a rail vehicle, comprising at least one accelerometer that is known per se and is provided on said rail vehicle. This accelerometer is to be mounted for at least detecting the axle box acceleration in the longitudinal direction, that is in the direction of the railway-track. It will be clear that the actual measurement direction of the accelerometer may deviate some degrees from the exact longitudinal direction. A suitable type of accelerometer to be used for this purpose is the Endevco® model 7259B lightweight piezo-accelerometer of the firm Meggitt.

Figure 1:
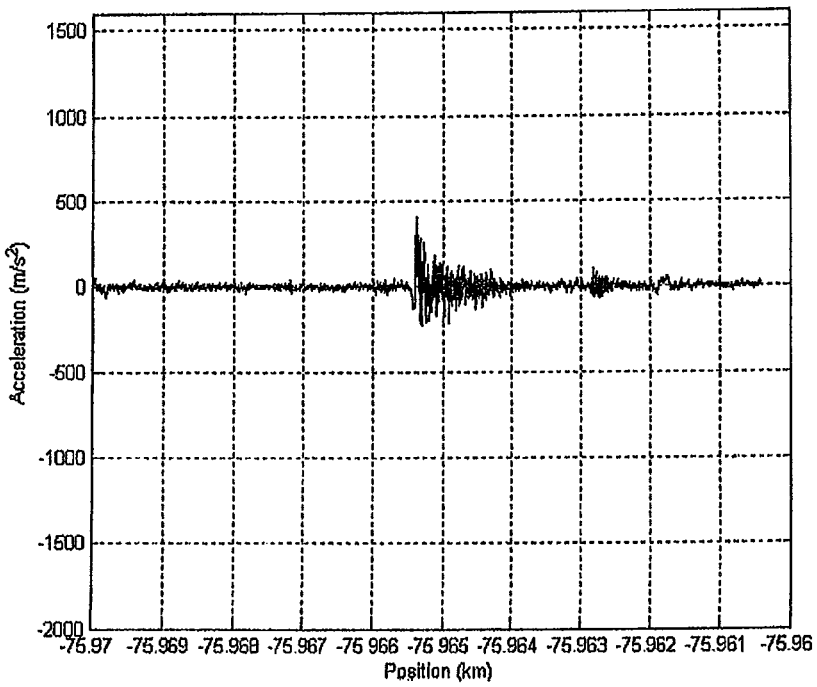
FIG. 1 shows the vertical axle box acceleration signal in accordance with the prior art.
Figure 2:
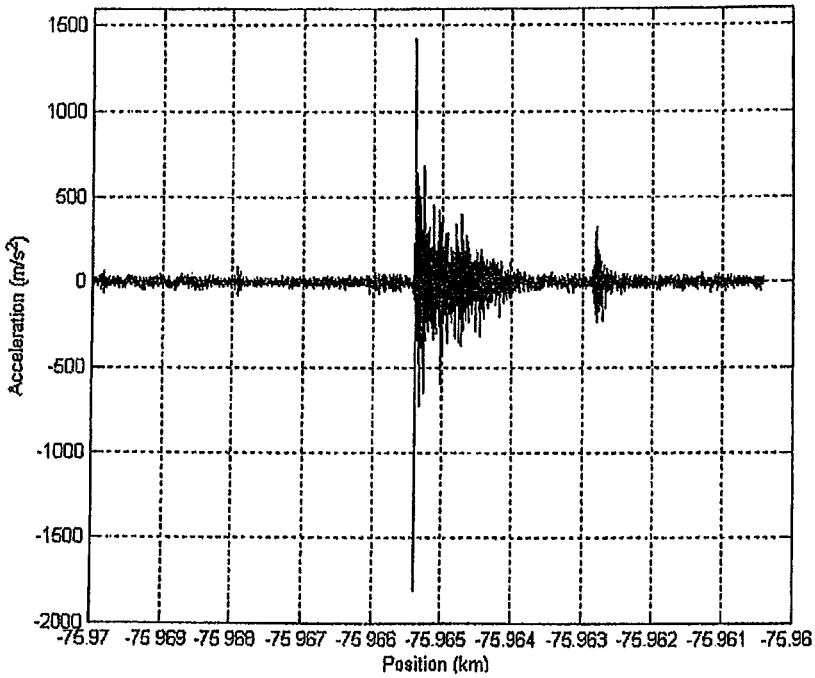
FIG. 2 shows the longitudinal axle box acceleration signal in accordance with the invention.

In comparison FIGS. 1 and 2 show that the longitudinal axle box acceleration signal is more sensitive than the vertical axle box acceleration signal. There are for instance two clear peaks in the longitudinal axle box acceleration signal (FIG. 2), the smaller peak of which is however hard to be distinguished in the signal representing the vertical axle box acceleration (FIG. 1).

Figure 3:
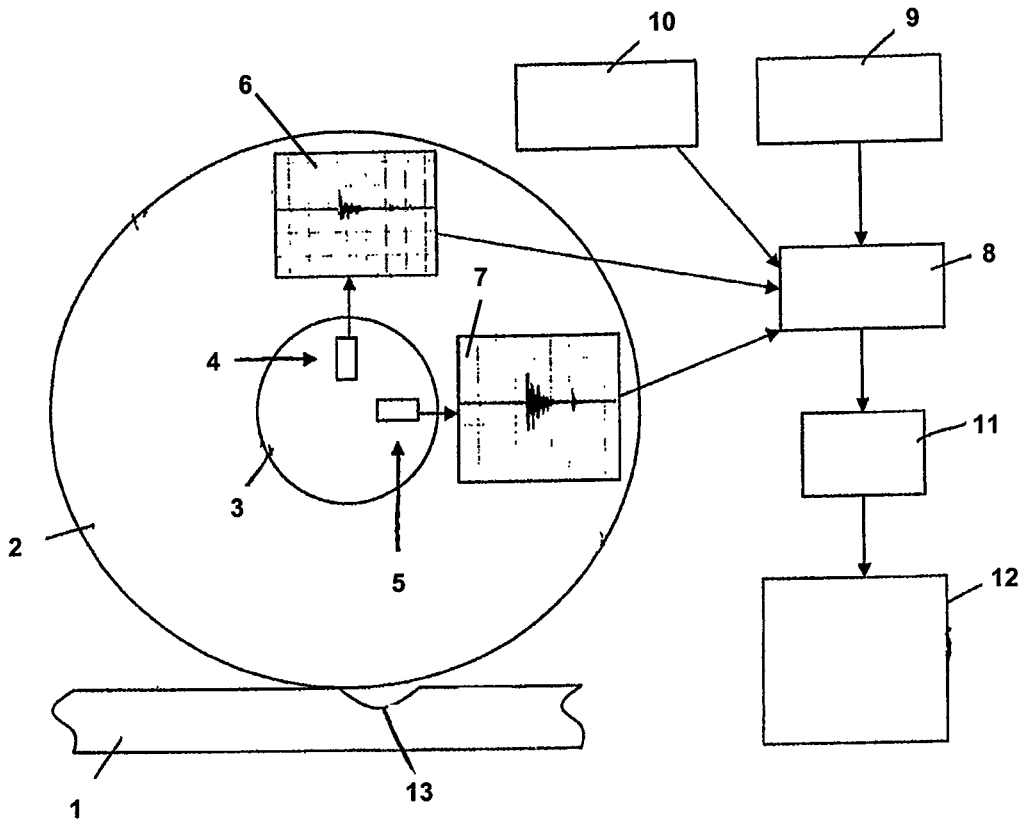
FIG. 3 provides a schematic representation of an instrumentation system for measuring axle box acceleration of a rail vehicle.

Turning now to FIG. 3 a schematic representation is shown of a rail 1 of which the rail defects, in particular rail top defects, are to be measured and localized. One such defect is schematically represented by reference numeral 13. The measurement of this defect 13 is carried out by employing a rail vehicle having at least one axle box 3 that provides a bearing for a rail wheel 2. The axle box 3 is provided with both a vertical accelerometer 4 and a longitudinal accelerometer 5.

The vertical accelerometer 4 provides a vertical acceleration signal as represented by graph 6, which is comparable to what FIG. 1 shows.

The longitudinal accelerometer 5 provides a longitudinal acceleration signal as represented by graph 7, which is comparable to what FIG. 2 shows.

The acceleration signals 6, 7 are acquired in a data acquisition process by data logger 8. Data logger 8 concurrently monitors the speed of the rail vehicle by the application of a tachometer 9, whereas the data logger 8 also logs position data acquired by GPS system 10.

With a sender 11 which is optional the data may be transferred to a computer system 12 in which data processing and diagnosis can be carried out, in order to analyze the nature of the rail defects and their localization along the track of the rail 1.

What is claimed is:

1. A method for detection of rail defects in a railway-track, the method comprising the steps of:

measuring axle box acceleration signals of a rail vehicle in motion down the railway-track, comprising measuring both a longitudinal axle box acceleration signal and a vertical axle box acceleration signal; and using the longitudinal axle box acceleration signal to remove from the vertical axle box acceleration signal an acceleration versus position signal-part that relates to vibrations of the rail vehicle's wheel set, including the bearing and axle box.

2. The method of claim 1 wherein the axle box acceleration signals are additionally filtered to remove signal-parts contributed by vibrations of the railway-track, including the rail, rail pads, sleepers, and ballast.

* * * * *